United States Patent [19]

Keim et al.

[11] Patent Number: 4,628,225

[45] Date of Patent: Dec. 9, 1986

[54] ELECTRODE FOR LASER STIMULATION LAMPS

[75] Inventors: Dieter Keim, Mühlheim/Main; Helmut Fischer, Hanau, both of Fed. Rep. of Germany

[73] Assignee: W. C. Heraeus GmbH, Hanau, Fed. Rep. of Germany

[21] Appl. No.: 543,614

[22] Filed: Oct. 20, 1983

[30] Foreign Application Priority Data

Nov. 2, 1982 [DE] Fed. Rep. of Germany ..... 3240359

[51] Int. Cl.[4] ..... H01J 61/06

[52] U.S. Cl. ..... 313/631; 313/574

[58] Field of Search ..... 313/632, 631, 574

[56] References Cited

U.S. PATENT DOCUMENTS 1,811,100 6/1931 Treacy ..... 313/631 X
3,054,014 9/1962 Gemsa ..... 313/574 X
3,405,303 10/1968 Koury et al. ..... 313/632 X
3,898,494 8/1975 Levy ..... 313/631 X

*Primary Examiner*—Palmer C. DeMeo
*Attorney, Agent, or Firm*—Frishauf, Holtz, Goodman & Woodward

[57] ABSTRACT

An electrode for laser stimulation lamps comprising an electrode element (2) of tungsten, a hollow cylindrical carrier body (3) of nickel or nickel alloy, and a mounting pin (6) of nickel, tungsten alloy, or nickel alloy. The parts are securely attached together. This construction reduces the variety of sizes and types of electrodes produced, facilitates subsequent manufacturing steps and improves mechanical stability by reducing overall weight. The electrode element (2) and the mounting pin (6) are seated at respectively opposite ends of the hollow cylindrical carrier, extending, at least in part, into the space defined by the hollow carrier and attached thereto.

11 Claims, 1 Drawing Figure

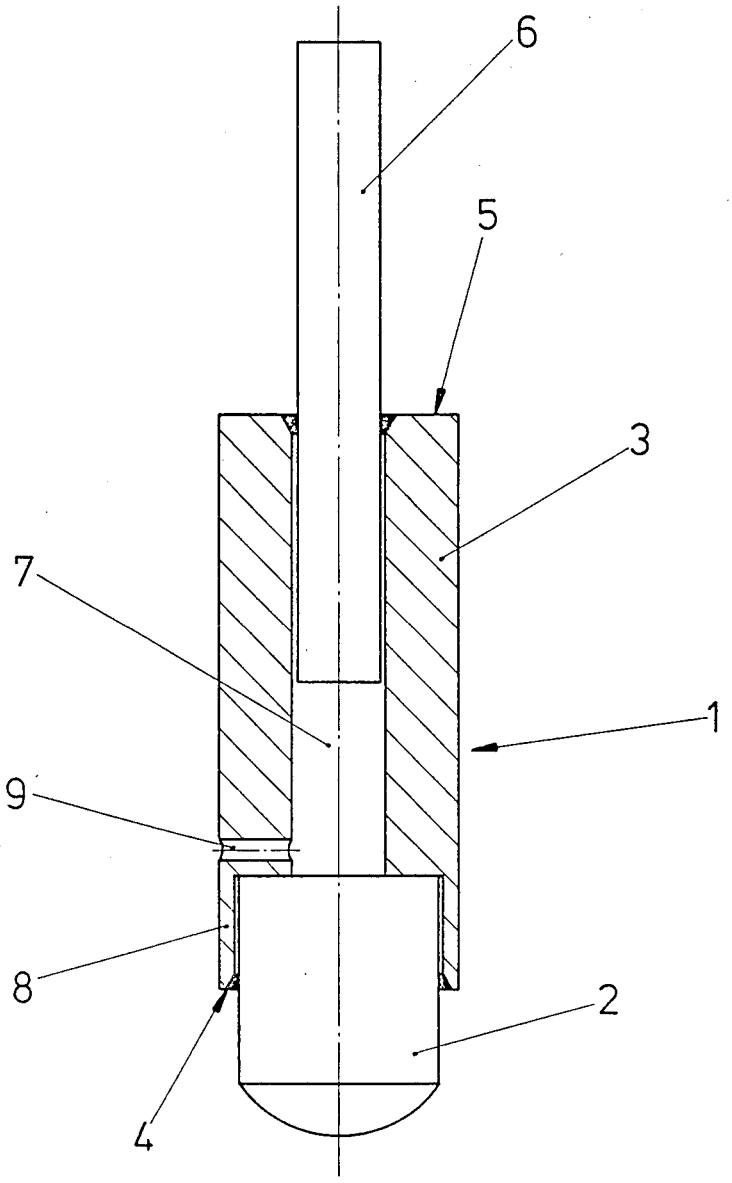
6
5
3
7
1
9
8
2
4

ELECTRODE FOR LASER STIMULATION LAMPS

The present invention relates to electrodes for laser stimulation lamps, and more particularly to electrodes which include a holding pin or holding bolt to permit electrical and mechanical connection of the electrode to a suitable external structure.

BACKGROUND

Electrodes for laser stimulation lamps usually have a material with a low work function for the emission of charge carriers, for example tungsten. Some such structures have an electrode body and a support pin or support bolt integral therewith. A single-unit element can be made by sintering. It is necessary to maintain predetermined geometric relationships of the diameter of the electrode body and the length of the overall electrode. If it is not possible to maintain the required relationships, the electrode may also be made by first constructing the electrode body without a carrier pin, then drilling an end face thereof and inserting the carrier pin into the thus formed bore. The electrode body and the carrier pin or bolt are then welded together.

Either one of the aforementioned methods permits construction of many types of electrodes with different diameters and overall lengths. An electrode made by the second aforementioned process is subject to wider tolerances, however, which is disadvantageous for subsequent use, and decreases the quality of the lamp with which it is to be used.

THE INVENTION

It is an object to provide an electrode which can be used in structures requiring various dimensions, so that a lesser number of types is required, with excellent tolerances.

Briefly, a support structure in form of a tubular or hollow, cylindrical body is provided. The electrode element itself is seated within the support body, leaving a portion of the internal hollow space free, the remaining portion being taken up by a support pin or support bolt which is fitted into the tubular opening of the carrier to be telescopically received therein, and secured thereto. Preferably, the carrier body has its opening enlarged at the end portion in which the electrode element is to be seated, the electrode element then being introduced into the enlarged opening. The carrier pin preferably extends partly into the hollow space of the lamp.

The support body may be made of nickel or a nickel alloy, the carrier pin of nickel or of a tungsten alloy or a nickel alloy.

The structure in accordance with the invention has the advantage that the centering of the electrode element itself is excellent, independent of the geometrical dimension of the overall structure of the laser stimulation lamp. Thus, the number of different electrode bodies, forming anodes or cathodes, can be held low. The respective materials used can be easily matched to electrical and mechanical requirements . The overall weight of the electrode structure is lower than that of similar structures of the prior art, thus increasing the mechanical stability of the lamp as a whole.

DRAWING

The single FIGURE is a longitudinal cross section through the electrode element, the carrier body, and the center support pin for the overall structure.

DETAILED DESCRIPTION

The electrode 1 has an electrode element 2, a carrier body 3, and a carrier pin or bolt 6. The carrier pin or bolt 6 is provided to secure the electrode mechanically in a lamp (not shown) and to provide for electrical current supply. The carrier body 3 is cylindrical and hollow, that is, is tubular. The carrier pin 6 and the electrode element 2 extend into the hollow portion of the tubular carrier body 3 from the respective end portions 5 and 4. The diameter of the electrode element 2 is greater than that of the carrier pin 6. The wall portion 8 of the electrode body 3 consequently is made thinner in the region of acceptance of the electrode element 2. An air communication hole 9 extends between the inside of the hollow body and the outside.

A suitable material for providing charge carrier emission for the electrode element 2 is, for example, tungsten. The shape of the electrode element 2 can be chosen according to whether it is to function as anode or cathode, while the geometric dimensions which do not have to be changed to satisfy those functional requirements can be kept constant. The diameter of the electrode element 2 may typically range from 4 mm to 6 mm, and the length typically will range from between 5 mm to 15 mm. The carrier 3 is preferably made of nickel and is therefore easier to work than tungsten. The dimensions of the carrier body 3 can be chosen according to the length and diameter requirements of the particular application. The center pin 6 comprises a material such as nickel, a tungsten alloy or a nickel alloy, whose expansion coefficient corresponds to that of the glass which is to be melted around the electrode. The center pin 6 is slidable in the carrier body 3 so that a central cavity inwardly of the end portion 5 is assured and that the total length of the electrode 1 corresponds to the desired dimensions.

The electrode element 2 and the carrier body 3 as well as the center pin 6 and the carrier body 3 can be attached by soldering with appropriate solder, by laser welding, by welding under protective gas, or mechanically by means of corrugations, detents, punch connections or the like. For welding and further machining or working, it is desirable to have a vent hole 9 in the carrier body to permit venting of air from the cavity 7 inside the carrier body 3 to ambient air.

Preferably, the central cavity in the carrier body 3 is widened at the electrode body 2 end, and the electrode body is placed in this widened space. The center pin 6 preferably projects partially from end 5 into the central cavity 7. The material of the carrier body 3 is preferably nickel or a nickel alloy, and that of the center pin 6 nickel or a tungsten or nickel alloy.

The electrode element has excellent centering independently of the particular geometric dimensions of the electrode. The number of different electrode bodies required for anodes and cathodes is small. The materials can be better matched to electrical and mechanical characteristics and requirements. The total weight of the electrode is less than that of conventional electrodes, so that the mechanical stability of the lamp is thereby increased.

Various changes and modifications may be made within the scope of the inventive concept.

I claim:

1. In combination with a laser stimulation lamp an easily length-adjustable electrode (1) comprising a tubular cylindrical carrier body (3) having a longitudinal central bore (7) and a vent hole (9) from said central bore (7) to an outer surface of said carrier body (3) to provide for communication between said central bore and the interior of said envelope (13);

an electrode element (2) of a material having a low work function for the emission of charge carriers secured and partially located within a widened portion of said central bore (7) at a first end portion (4) of said carrier body (3), said electrode element projecting from said first end portion of the carrier body (3)

a mounting pin (6) of predetermined length having a first terminal portion telescopically received within and located partially in said central bore (7), telescopically slidable into and out of said central bore (7) through a second end portion (5) of the carrier body (3);

and means (10*a*, 10*b*) for securing the mounting pin in fixed position within said central bore to determine the total length of the electrode, said positioning means permitting locating the carrier body (3) at a selected axial position with respect to the mounting pin and to locate the carrier body (3) and hence the electrode element (2) projecting from the carrier body at a selected position to thereby define the total length of the electrode.

2. An electrode according to claim 1, wherein the carrier body (3) comprises a cylindrical, tubular body, and the electrode element comprises a cylindrical element seated in the central cavity at an end portion thereof.

3. An electrode according to claim 2, wherein said central cavity (7) is widened at the end in which the electrode element (2) is seated to form a widened end portion (4); and the electrode element (2) is seated in the widened end portion.

4. An electrode according to claim 3, wherein the mounting pin (6) and said electrode element (2) are located in axial alignment.

5. An electrode according to claim 1, wherein the material of the carrier body (3) is nickel or a nickel alloy.

6. An electrode according to claim 1, wherein the material of the mounting pin (6) comprises nickel or an alloy of tungsten and nickel.

7. An electrode according to claim 1, wherein said electrode body (2) and said mounting pin (6) are cylindrical in configuration.

8. An electrode according to claim 1, wherein said central cavity (7) is widened at the end in which the electrode element (2) is seated to form a widened end portion (4);

and the electrode element (2) is seated in the widened end portion.

9. An electrode according to claim 1, wherein the material of the electrode element (2) comprises tungsten.

10. An electrode according to claim 1, wherein the material of the carrier body (3) is nickel or a nickel alloy;

and the material of the mounting pin (6) comprises nickel or an alloy of tungsten and nickel.

11. An electrode according to claim 1, wherein the material of the carrier body (3) is nickel or a nickel alloy;

the material of the mounting pin (6) comprises nickel or an alloy of tungsten and nickel; and the material of the electrode element (2) comprises tungsten.

* * * * *